United States Patent [19]

Chevalier et al.

[11] Patent Number: 4,914,724

[45] Date of Patent: Apr. 3, 1990

[54] ELECTRON GUN FOR CATHODE RAY TUBE

[75] Inventors: Jacques Chevalier, Jarrie; Jean P. Sembely, St. Egreve, both of France

[73] Assignee: Thomson-CSF, Paris, France

[21] Appl. No.: 276,668

[22] Filed: Nov. 28, 1988

[30] Foreign Application Priority Data

Dec. 1, 1987 [FR] France ..... 87 16635

[51] Int. Cl.[4] ..... H01J 29/58; H01J 29/46

[52] U.S. Cl. ..... 315/382; 313/449; 315/14

[58] Field of Search ..... 315/382, 382.1, 14, 315/15, 10, 13.11; 313/414, 449

[56] References Cited

U.S. PATENT DOCUMENTS 4,009,410 2/1977 Pommier et al. ..... 313/411

FOREIGN PATENT DOCUMENTS 2726663 12/1977 Fed. Rep. of Germany ..... 313/449

OTHER PUBLICATIONS

Patent Abstracts of Japan, vol. 4, No. 152, (E-31)[634], Oct. 24, 1980.

IEEE Transactions on Broadcast and Television Receivers, vol. 21, No. 1, Feb. 1975, pp. 57-62, New York, U.S.

*Primary Examiner*—Thomas H. Tarcza

*Assistant Examiner*—Gregory C. Issing

*Attorney, Agent, or Firm*—Oblon, Spivak, McClelland, Maier & Neustadt

[57] ABSTRACT

Disclosed is an electron gun for cathode ray tubes successively comprising an electron source electrode or cathode, a control or Wehnelt electrode, a first acceleration electrode or anode carried to an adjustable voltage and at least one focusing or second acceleration electrode in which there is inserted, between the first acceleration electrode and the focusing or second acceleration electrode, an additional electrode which is carried, during operation, to a fixed biase voltage, this electrode forming a low-powered electrostatic lens with the anode electrode and forming a high-powered electrostatic lens with the second acceleration electrode.

5 Claims, 1 Drawing Sheet

ELECTRON GUN FOR CATHODE RAY TUBE

BACKGROUND OF THE INVENTION

1. Field of the Invention

The invention concerns an electron gun for cathode ray tubes of the type with focusing of the beam by magnetic lenses or electrostatic lenses having high resolution and high luminance.

2. Description of the Prior Art

A cathode ray tube (CRT) is the unit formed by a chamber under vacuum within which is placed an electron gun producing an electron beam that bombards a luminescent screen.

The electron gun has a set of electrodes and, if necessary, deflection plates. The source of electrons is conventionally formed by a cathode with alkali/earth oxides heated by a filament. The thermionic emission of electrons is stimulated by an electrical field created between the cathode and the acceleration electrode. A control or Wehnelt electrode, formed by a metallic cup-like piece surrounding the cathode and having a small-diameter hole in the axis of the tube, enables the modification of the electrical field and enables checking the intensity of the electrons emitted and, consequently, checking the beam current and, finally, checking the luminance of the screen trace.

In order to limit the divergence of the beam, conventionally an electron gun is used, such as the one shown in FIG. 1. This gun has an electron source electrode or emitting cathode 1, a Wehnelt electrode or control electrode 2, a first acceleration electrode or anode 3 and then an electrode 4 which, as the case may be, may be a final acceleration electrode or a focusing electrode.

Each electrode is subjected, in operation, to a bias voltage, respectively V1, V2, V3, V4 and, possibly, V5 if there is both a final acceleration electrode and a second focusing electrode available.

A pre-focusing of the electron beam is performed to obtain a beam with a small diameter throughout its length as well as a low inclination of the rays with respect to the axis of the beam. This pre-focusing is got by the effect of the pre-focusing lens formed by the electrodes 3 and 4. A main focusing lens is formed, as the case may be, by a magnetic lens placed outside the neck of the tube or by an electrostatic lens formed, for example, by the electrodes 4 and 5.

Bias voltages V3 and V4 are applied, in operation, in a voltage ratio of V4/V3 which, depending on the type of gun, may be high (about 15) or low (about 5 to 8). Bias voltages V5 and V4 are applied during operation, in a voltage ratio V5/V4 which is low (about 4 to 6).

The anode electrode 3 has a plane side or, preferably, a plane input disk 13, drilled at its center with a circular hole 17. The first focusing electrode 4 has a plane side or, preferably, a plane input disk 14, also drilled with a circular hole 18 at its center. The input disks 13 and 14 of the electrodes 3 and 4 are parallel to each other and are orthogonal to the axis of the electron beam 21 going through their center. The first focusing electrode 4 has a plane side or, preferably, a plane output disk 15, and the second focusing electrode 5 has a plane side or, preferably, a plane input disk 16. The two disks 15 and 16, each drilled with a circular hole, 20 and 19 respectively, at their center, are parallel to each other and orthogonal to the axis of the electron beam 21 going through their center.

The pre-focusing lens is therefore formed by the parallel disks 13 and 14 of the electrodes 3 and 4 provided with their holes. The second or main lens is formed by the parallel disks 15 and 16 of the electrodes 4 and 5 provided with their holes.

The voltage ratio V5/V4 may be low in comparision with the voltage ratio V4/V3. However, owing to its geometrical constitution, the power of the said second lens is sufficient to provide the main focusing. The input hole 18 of the electrode 4 is formed by a circular hole of small . diameter. This hole causes a curvature in the field lines and a narrowing of the beam at its level. The second lens or main lens forms the image of an object on the screen. The position and diameter of this image vary little with the throughput of the cathode, thus providing little variation in the dimension of the spot on he screen. The deflection of the electron beam is got by means of any standard deflector (not shown in FIG. 1). A control voltage V2 is applied to the Wehnelt electrode. For a certain value of V2, it is possible to cancel the cathode current. This value of V2 is called the cut-off voltage.

The cut-off voltage of the electron beam depends on the dimensions of the elements forming the gun, especially the distances between the Wehnelt-cathode electrodes and the Wehnelt-anode electrodes and the diameters of the holes of the input side of each of these electrodes.

However, in practice, this cut-off voltage never takes exactly the same value for each tube manufactured, owing to manufacturing tolerances. The variation in this cut-off voltage, between different tubes of one and the same model, makes it necessary to do a setting. This setting may be done on the voltage V2 of the control electrode. However, it is generally preferred to do this setting on the bias voltage V3 of the anode, for it is easier to obtain an adjustable supply for the bias voltage of the anode than for the voltage of the control electrode..

It so happens that for electron guns for high-performance CRTs, the adjusting of the cut-off voltage, through a setting of the bias voltage of the anode causes deterioration, either in resolution or in brilliance depending on whether the gun has a higher or lower cut-off voltage in the setting range. The variation in electro-optical characteristics from one tube to another, in the same manufactured batch, is thus quite large and may raise problems for high quality equipment, where the performance characteristics have to be very stable and uniform.

SUMMARY OF THE INVENTION

The present invention makes it possible to overcome these problems by proposing an electron gun wherein an additiional electrode is inserted between the first acceleration electrode or anode and the focusing electrode, this additional electrode having a fixed bias voltage, the value of which located in the setting range of the bias voltage of the anode.

An object of the present invention, therefore, is an electron gun for cathode ray tubes, successively comprising an electron source electrode or cathode, a control or Wehnelt electrode, a first acceleration electrode or anode carried to an adjustable voltage and at least one focusing or second acceleration electrode, chiefly comprising an additional electrode inserted between the first acceleration electrode or anode and the focusing electrode; wherein this additional electrode is carried to a fixed bias voltage, the additional electrode forming a first low-powered lens with the first acceleration electrode and forming a high-powered lens with the focusing electrode.

BRIEF DESCRIPTION OF THE DRAWING

The invention will be better understood from the following description, given as a non-restrictive example and made with reference to the following figures, of which:

FIG. 1 shows the diagram of a prior art electron. This figure has already been described, and shall not be the subject of a more detailed description.

DESCRIPTION OF A DETAILED EMBODIMENT

Figure 1:
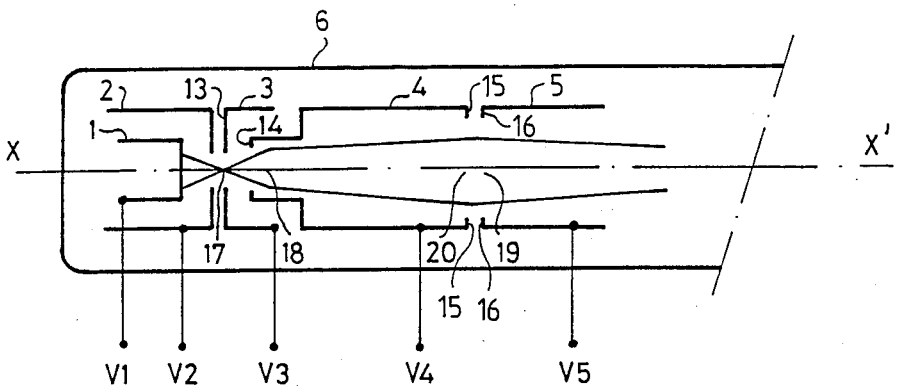
FIG. 1 PRIOR ART
FIG. 1 shows a diagram of an electron gun according to the prior art.
Figure 2:
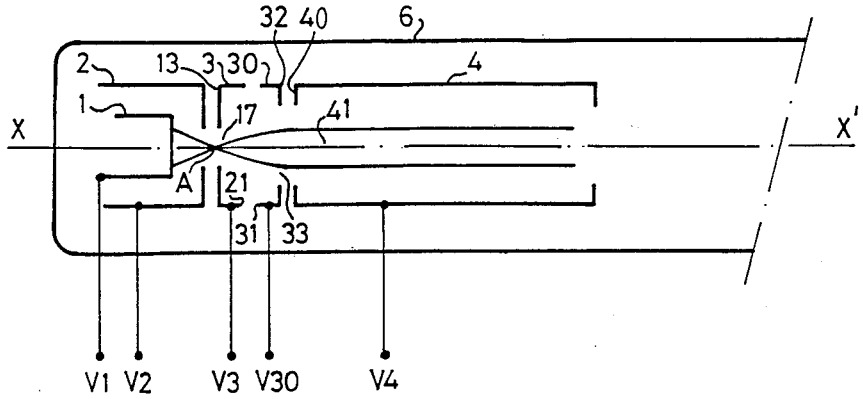
FIG. 2 shows a diagram of an electron gun according to the invention.

FIG. 2 shows a partial drawing of an electron gun according to the invention. Only the part comprising all the electrodes, namely electron source, control, first acceleration and focusing electrodes, which are covered by the invention, has been shown. These electrodes are placed in the chamber 6 under vacuum. The electron gun has a succession of electrodes where the electrode 1 is an emitting electrode, the electrode 2 is a control or Wehnelt electrode, the electrode 3 is a first acceleration electrode or anode, the electrode 30 is a focusing electrode and the electrode 4 is a focusing electrode also producing a second acceleration. The gun may also have another electrode, to accomplish a third acceleration, such as the electrode 5 shown in FIG. 1 of the prior art. Each electrode is subjected, during operation, to a bias voltage, respectively V1, V2, V3, V30, V4.

According to the invention, the electrode 3 and the electrode 30 form a low-powered focusing lens while the electrode 30 and the electrode 4 form a high-powered focusing lens. A pre-focusing of the electron beam is got by means of the first lens formed by the electrodes 3 and 30, which has a weak effect, and the second lens formed by the electrodes 30 and 4.

According to the invention, the additional electrode, formed by the electrode 30, is placed between the anode 3 and the electrode 4. This electrode 30 has a bias voltage V30, the value of which is located in the setting range of the anode bias voltage. The bias voltages applied, during operation, to the electrodes 3 and 30 have a low ratio V30/V3, with V3 being substantially equal to V30, to within 30%. The bias voltages applied, during operation, to the electrodes 30 and 4 have a high ratio V4/V30, greater than or equal to 10. The bias voltage V3 of the anode electrode 3 is adjustable, and can be adjusted to obtain the desired cut-off voltage of the electrons.

The anode electrode 3 has a plane side which is preferably an input plane disk 13, drilled at its center with a circular hole 17. This electrode has a rear side 21 which is entirely open and which faces the front side 31 of the electrode 30. The electrode 30 has a rear side formed by a plane disk 32 drilled with a circular hole 33. The electrode 4 has a front side 40 facing the rear side 32, drilled with a hole 41. The front and rear sides of each of the electrodes are parallel to each other and orthogonal to the axis XX' of the electron beam 7.

Thus, according to the invention, the addition of the fixed bias electrode 30, facing the electrode 4, and the choice of the voltage bias values so that the ratio of these bias voltages is high, makes it possible to obtain a powerful lens which focuses the electron beam, the beam having a low diameter throughout its length at the output of the electrostatic lens 30-4.

The addition of the electrode 30 also makes it possible to adjust the bias voltage of the anode in order to set the cut-off voltage of the electron beam without thereby modifying the characteristics of the beam in any way. In the prior art, these modifications result in either low efficiency or poor resolution. The lenses formed by the electrodes 3 and 30 and the electrodes 30 and 4 have a large diameter and thus provide pre-focusing of the beam without contributing any aberration to the sphericity of the screen, and thus make it possible to have high resolution and high luminance.

According to a preferred embodiment, the diameters of the holes of the electrodes 2 and 3 are of the same magnitude as those in a standard gun. The diameter of the holes 21 and 31 is of the magnitude of the external diameter of the electrodes which are cylindrically shaped. The diameters of the holes 33 and 41 are of the same magnitude and may be chosen between 2 and 6 mm. The distance between the sides 32 and 40 of the electrodes 30 and 4 is of the order of 0.2 to 1 mm. The distance between tte point A of the narrowing area located in the space included between the electrodes 2 and 3 and the disk 32 of the electrode 30 is between 5 mm. and 10 mm.

What is claimed is:

1. An electron gun for cathode ray tubes, successively, comprising an electron source electrode or cathode, a control or Wehnelt electrode, a first acceleration electrode or anode having an adjustable voltage and at least one focusing or second acceleration electrode, comprising an additional electrode inserted between the first acceleration electrode or anode and the focusing or second acceleration electrode; wherein said additional electrode is carried to a fixed bias voltage V30, said additional electrode forming a first low-powered lens with the first acceleration electrode and forming a high-powered lens with the focusing electrode and wherein said bias voltage V30 is substantially equal, to within 30 percent, to the bias voltage to which the first acceleration electrode is raised.

2. An electron gun for cathode ray tubes according to claim 1, wherein the bias voltage V30, to which the additional electrode is carried, is about ten times lower than the bias voltage of the focusing electrode.

3. An electron gun for cathode ray tubes according to claim 1, wherein the control and first acceleration electrodes are formed by cylindrical parts comprising facing sides each having a circular hole with a predefined diameter, the centers of these cylindrical parts being located on the same axis XX', wherein the additional electrode and the second acceleration electrode are formed by cylindrical parts, comprising facing plane sides each having a small-diameter hole forming the high-powered lens, the additional electrode and the first acceleration electrode having facing holes forming the low-powered lens, the holes having centers located on the axis XX'; the bias voltage V3 of the first acceleration electrode being equal to the bias voltage V30 of the additional electrode, plus or minus 30% of this value, and the ratio V4/V30 between the bias voltage V4 of the second acceleration electrode and bias voltage V30 of the additional electrode being greater than 10.

4. An electron gun for cathode ray tubes according to claim 2, wherein an area for the narrowing of the beam occurs between the plane sides of the control and first acceleration electrodes, wherein the distance between the central point of this narrowing area and the high-powered lens formed by the additional electrode and the second acceleration electrode is in the range of 5 to 10 mm.

5. An electron gun for cathode ray tubes according to claim 3, wherein the diameter of the facing holes of the first acceleration and additional electrodes is approximately the diameter of these electrodes.

* * * * *